United States Patent [19]

Castle

[11] Patent Number: 4,521,934

[45] Date of Patent: Jun. 11, 1985

[54] TAPE WIPER

[76] Inventor: Gary Castle, 4811 Forster, Schiller Park, Ill. 60176

[21] Appl. No.: 555,137

[22] Filed: Nov. 25, 1982

[51] Int. Cl.[3] ..... A47L 17/06

[52] U.S. Cl. ..... 15/236 R; 15/236 A

[58] Field of Search ..... 15/236 R, 236 A, 104 R, 15/104 S; 17/43

[56] References Cited

U.S. PATENT DOCUMENTS

| | | | |
|---|---|---|---|
| 1,190,547 | 7/1916 | Hecke | 15/236 R |
| 2,825,916 | 3/1958 | Basala, Jr. | 15/236 R |
| 3,486,183 | 12/1969 | Caprioli | 15/236 R X |
| 3,670,459 | 6/1972 | Welton | 15/236 R X |
| 3,745,622 | 7/1973 | DeAmicis | 15/236 R X |
| 4,381,576 | 5/1983 | Nishikawa | 15/236 R |

FOREIGN PATENT DOCUMENTS

| | | | |
|---|---|---|---|
| 767456 | 2/1957 | United Kingdom | 15/236 |

*Primary Examiner*—Timothy F. Simone

*Attorney, Agent, or Firm*—Lee, Smith & Zickert

[57] ABSTRACT

A device for cleaning the surfaces of a generally flat tape as the tape is wound into a tape cartridge. Spring-loaded jaws engage opposite sides of the tape and each jaw is provided with a scraping edge adjacent the tape to strip debris from the tape as it is rewound into the tape cartridge. The tips of the jaws interlock to prevent inadvertent release of the device from the tape. The device is removable from the tape whenever desired.

9 Claims, 4 Drawing Figures

TAPE WIPER

BACKGROUND OF THE INVENTION

This invention relates to devices for cleaning a long, flexible tape as the tape is rewound onto a hub, the hub usually being located within a tape housing and dispensing cartridge.

Flexible measuring tapes in various lengths are quite common and typically are stored on a hub located within a casing or cartridge which is used to house and dispense the tape as required. The hub may be spring-loaded so that the tape is automatically rewound into the cartridge, or the hub can include a manual hub crank for retracting of the tape into the cartridge. In either case, the cartridge is shaped to fit closely about the tape in its retracted state so that the bulk of the cartridge is maintained at a minimum.

A measuring tape is used for many purposes, and often the measuring tape is employed where it can come into contact with contaminants which will cling to the tape, such as mud or other debris. If the contaminants are not removed from the tape before the user attempts to rewind the tape into the hub, the added bulk of the contaminants often prevents the tape from being fully retracted into the tape cartridge. As a result, the tape must be withdrawn and manually cleaned by the tape user so that its bulk is reduced sufficiently to permit its full retraction into the tape cartridge.

Various devices have been proposed for cleaning contaminants and other clinging materials from a tape. For example, U.S. Pat. No. 4,060,873 describes a device having flexible rubber tips which extend on the opposite sides of a photographic film for removing liquids from the film as it is drawn between the tips. U.S. Pat. Nos. 531,951 and 2,706,503 disclose flexible devices, such as pads or brushes, which can be located on opposite sides of a band saw blade for cleaning the blade. Finally, U.S. Pat. No. 2,979,753 discloses a device for cleaning a clothes line which surrounds the clothes line with a flexible material, such as a sponge.

U.S. Pat. No. 3,324,560 discloses a device for a measuring tape which can be employed to stop the tape at desired lengths of retraction from the tape cartridge. The device itself does not clean the tape since in one orientation it permits the tape to freely pass between its parallel parts while in another orientation, it is locked to the tape.

While the prior art may be sufficient for their various purposes provided, none is adequate for cleaning a flexible measuring tape. None of the devices has a substantially rigid blade for stripping undesired debris from the tape as the tape is wound into a cartridge, nor are any of the devices readily and quickly removable from the tape when no longer desired to be secured about the tape.

SUMMARY OF THE INVENTION

The invention relates to a novel device for cleaning the surfaces of a long, flexible tape as the tape is wound onto a hub. The invention includes a pair of jaws extending across the tape, with the jaws being complementary to one another and each jaw being shaped to engage an opposite surface of the tape with the tape located between the jaws. The jaws are hingedly secured together at one end thereof and include means resiliently urging the jaws toward one another to close the jaws about the tape. Each of the jaws is provided with means for stripping undesired debris from the tape as the tape is wound onto the hub.

In the preferred embodiment of the invention, the stripping means comprises a scraping edge formed in each jaw immediately adjacent the tape so that debris is scraped from the tape as it is rewound onto the tape hub. The scraping edges are oriented on one side of the jaws toward the free end of the tape so that scraping occurs only as the tape is rewound onto the hub.

In order to assure that the device is retained on the tape as it is being rewound, the jaws include interlocking tips at their ends opposite the hinge. Thus, the tape is retained between the hinge and the tips and cannot inadvertently slip from between the jaws.

In the preferred embodiment, the resilient urging means comprises a spring which also serves as the hinge. In order to facilitate opening of the jaws, each of the jaws includes a wing extending outwardly at an oblique angle to the other so that the wings can be squeezed towards one another to spread the jaws and permit removal of the device from the tape.

BRIEF DESCRIPTION OF THE DRAWINGS

One embodiment of a device according to the invention is described in greater detail in the following description of an example embodying the best mode of the invention, taken in conjunction with the drawings, in which.

DESCRIPTION OF EXAMPLE EMBODYING BEST MODE OF THE INVENTION

Figure 1:
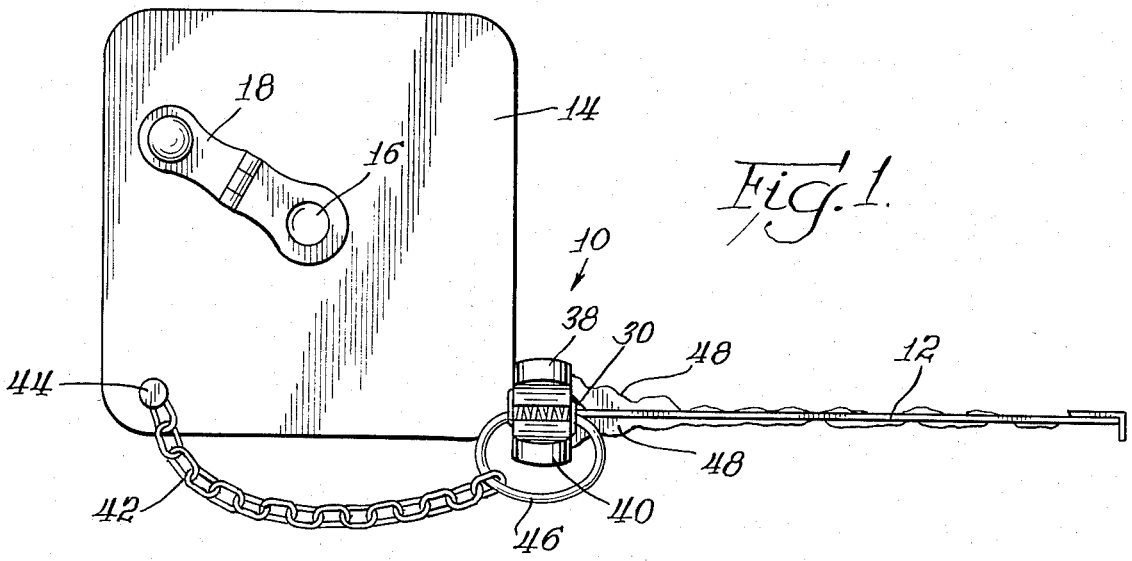
FIG. 1 is a side elevational illustration of the invention clamped about a tape which is partially withdrawn from a tape cartridge.
Figure 2:
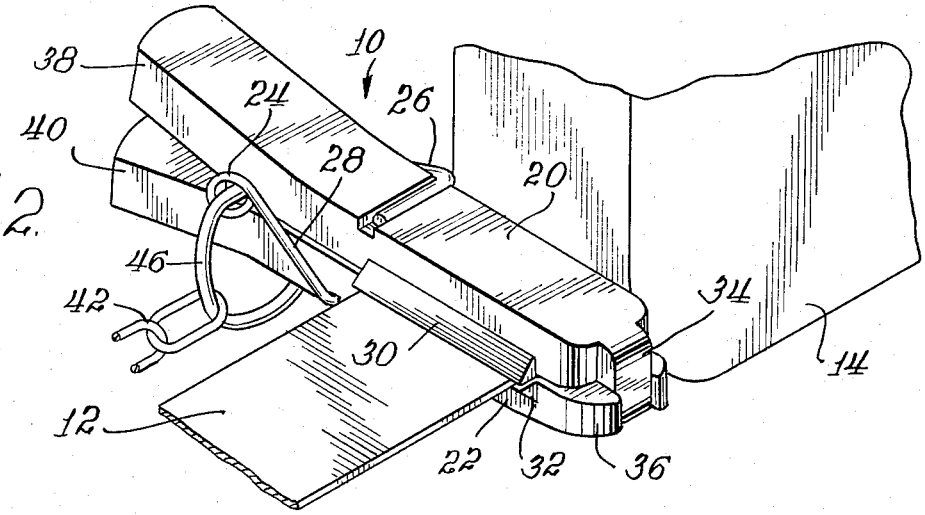
FIG. 2 is an enlarged perspective view of the device according to the invention secured about the tape withdrawn from a tape cartridge.

A tape cleaning device according to the invention is shown generally at 10 in the drawing figures. It is shown engaged about a tape 12 which is partially extended from a tape housing and dispensing cartridge 14. The tape can be manually rewound upon a hub 16 in the cartridge 14 by means of a crank 18, or, if desired, the hub 16 can be spring-loaded so that the tape 12 is automatically retracted into the cartridge 14. The tape 12 and cartridge 14 are conventional and form no part of the invention, and therefore are not described in further detail.

The tape cleaning device 10 is composed of a pair of jaws 20 and 22 which extend across the tape 12. The jaws 20 and 22 are complementary to one another and each jaw is shaped, as illustrated, to engage an opposite surface of the tape 12 with the tape 12 located between the jaws 20 and 22. Although the jaws 20 and 22 are shown engaging a flat tape 12 therebetween, it is evident that should the tape 12 be curved in cross-section, the jaws 20 and 22 would be formed accordingly to accommodate the particular cross-sectional configuration of the tape 12.

Figure 3:
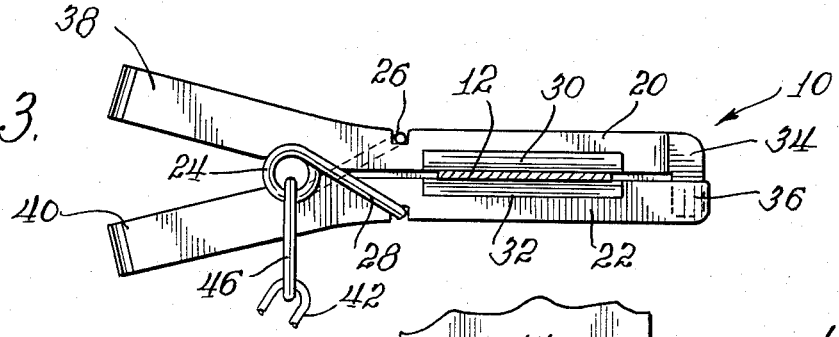
FIG. 3 is a side elevational illustration of the device according to the invention looking in the direction toward the tape cartridge, but with the tape cartridge removed for purposes of clarity.
Figure 4:
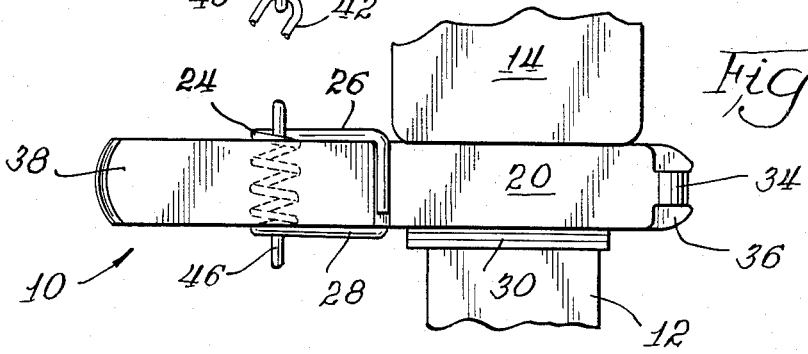
FIG. 4 is a top view of the invention with portions of the tape and tape cartridge broken away.

The jaws 20 and 22 are hingedly secured together by means of a spring 24 which also serves to urge the jaws 20 and 22 toward one another to close them about the tape 12. As best seen in FIG. 3, one leg 26 of the spring 24 extends into a transverse groove formed in the top jaw 20, while a second leg 28 of the spring 24 extends into a transverse groove formed in the bottom jaw 22. The spring 24 may be similar to that of a common clothes pin and therefore serves the dual functions of hinging the jaws 20 and 22 and also urging the jaws 20 and 22 toward one another. Alternatively, the spring 24 can be replaced by a hinge interconnecting the jaws 20 and 22 and a separate spring can be employed to urge the jaws 20 and 22 toward one another about the tape 12.

Each jaw 20 and 22 is provided with a respective scraping edge 30 and 32 immediately adjacent the tape 12. As shown in the drawings, the scraping edges extend at least the width of the tape 12 to scrape any debris therefrom.

The jaw 20 includes a tip 34 which extends downwardly and interlocks with a corresponding groove formed in the tip 36 of the lower jaw 22. Thus, the combination of the interlocking tips 34 and 36 and the hinge 24 on opposite sides of the tape 12 permit inadvertent removal of the tape cleaning device 10 from the tape 12. It is evident that the tips can be formed in other interlocking configurations to produce the same retaining function.

To facilitate easy and rapid removal of the device 10 from the tape 12, a wing 38 extends outwardly from the jaw 20 and a second wing 40 extends outwardly from the jaw 22. Preferrably, the wings 38 and 40 are integral extensions of the respective jaws 20 and 22 and, as shown, the wings 38 and 40 extend at an oblique angle to each other so that the user may squeeze the wings 38 and 40 toward one another against the biasing force of the spring 24 in order to open the jaws 20 and 22 to release the tape 12 therefrom.

Since the device 10 is relatively small and is readily removable from a tape 12, it can be easily lost if not attached to the cartridge 14. A chain 42 is provided to secure the tape cleaning device 10 to the cartridge 14, the chain extending between a pin 44 attached to the cartridge 14 and a ring 46 passing through the center of the hinge 24.

Normally, when the tape 12 is being extended from the cartridge 14, the tape cleaning device 10 is removed from the tape 12. If the tape 12 becomes encrusted with debris 48 such as mud or other contaminants, the device 10 is secured about the tape 12 in the manner shown in the drawing figures and, as the tape 12 is rewound into the cartridge 14, the scraping edges 30 and 32 remove the debris 48 from the tape 12. The inclination of the scraping edges 30 and 32, as illustrated, assures that the debris 48 is stripped from the tape 12 as it is rewound into the cartridge 14.

Various changes may be made to the invention without departing from the spirit thereof or scope of the following claims.

What is claimed is:

1. A portable device for cleaning the surfaces of a long, flexible tape as the tape is wound through a guide into a hub, comprising a. a pair of jaws extending across the tape, said jaws being complementary to one another and each jaw being shaped to engage an opposite surface of the tape with the tape located between the jaws when the jaws are closed, b. means hingedly secured the jaws together at one end thereof, c. each jaw including a portion of an interlocking tip, said tips being located at an end of said jaws opposite to said securing means, and said tips interlocking when said jaws are closed to contain said tape between the confines of the combination of said tips, said jaws and said securing means, d. means resiliently urging said jaws toward one another to close said jaws about the tape, and e. means on each jaw for stripping undesired debris from the tape as the tape is wound onto a hub.

2. A device according to claim 1 including means attaching said device to the tape hub.

3. A device according to claim 2 in which said attaching means comprises a chain extending between said device and said hub.

4. A device according to claim 1 in which said stripping means comprises a scraping edge formed in each jaw adjacent said tape.

5. A device according to claim 1 in which said urging means comprises a spring.

6. A device according to claim 5 in which said spring comprises said securing means.

7. A device according to claim 1 including means to facilitate opening of said jaws.

8. A device according to claim 7 in which said means to facilitate opening comprises a wing extending outwardly from each jaw at said securing means, said wings extending at an oblique angle to one another.

9. A portable device for cleaning the opposite surfaces of a generally flat, flexible tape as the tape is wound into a tape housing and dispensing cartridge, comprising, a. a pair of elongated jaws, said jaws being complementary to one another and each jaw being shaped to butt the other jaw and engage an opposite surface of the tape with the tape located between the jaws, b. a hinge at one end of said jaws securing said jaws together, c. a spring at said hinge resiliently urging said jaws toward one another to close said jaws about the tape, d. each jaw including a portion of an interlocking tip, said tips being located at an end of said jaws opposite to said hinge, and said tip interlocking when said jaws are closed to contain said tape between the confines of the combination of said tips, said jaws and said hinge, e. a scraping edge formed in each jaw adjacent said tape for stripping undesired debris from the tape as the tape is wound into said cartridge, and f. a chain attached to said device and to said cartridge to prevent separation of said device from said cartridge.

* * * * *